US011053775B2

(12) United States Patent
Kovalev et al.

(10) Patent No.: US 11,053,775 B2
(45) Date of Patent: Jul. 6, 2021

(54) DOWNHOLE INDUCTION HEATER

(71) Applicants: Leonid Kovalev, Astrakhan (RU); Shalva Shalyakhov, Moscow (RU); Nikolai Kudriashov, Moscow (RU); Mikhail Mirzoyan, Moscow (RU); Aleksey Vasil'ev, Odintsovo (RU)

(72) Inventors: Leonid Kovalev, Astrakhan (RU); Shalva Shalyakhov, Moscow (RU); Nikolai Kudriashov, Moscow (RU); Mikhail Mirzoyan, Moscow (RU); Aleksey Vasil'ev, Odintsovo (RU)

( * ) Notice: Subject to any disclaimer, the term of this patent is extended or adjusted under 35 U.S.C. 154(b) by 445 days.

(21) Appl. No.: 16/193,728

(22) Filed: Nov. 16, 2018

(65) Prior Publication Data

US 2020/0157918 A1 May 21, 2020

(51) Int. Cl.

| | |
|---|---|
| ***E21B 37/00*** | (2006.01) |
| ***H05B 6/10*** | (2006.01) |
| ***E21B 47/12*** | (2012.01) |
| ***E21B 36/04*** | (2006.01) |
| ***H05B 6/38*** | (2006.01) |
| ***E21B 47/07*** | (2012.01) |

(52) U.S. Cl.

CPC ..... *E21B 37/00* (2013.01); *E21B 36/04* (2013.01); *E21B 47/07* (2020.05); *E21B 47/12* (2013.01); *H05B 6/101* (2013.01); *H05B 6/38* (2013.01)

(58) Field of Classification Search

CPC ..... E21B 37/00; E21B 47/07; E21B 47/12; H05B 6/101; H05B 6/38

USPC ..... 219/628, 629, 630, 633, 635, 643, 644

See application file for complete search history.

(56) References Cited

U.S. PATENT DOCUMENTS

| | | | | |
|---|---|---|---|---|
| 2,757,739 A * | 8/1956 | Douglas | E21B 36/04 | 166/61 |
| 4,319,632 A * | 3/1982 | Marr, Jr. | E21B 43/24 | 166/241.6 |
| 4,453,319 A * | 6/1984 | Morris | E21B 21/065 | 134/19 |
| 4,538,682 A * | 9/1985 | McManus | E21B 37/00 | 166/304 |
| 7,096,953 B2 * | 8/2006 | de Rouffignac | E21B 41/0057 | 166/302 |

(Continued)

*Primary Examiner* — Jimmy Chou

(74) *Attorney, Agent, or Firm* — Aleksandr Smushkovich

(57) ABSTRACT

An induction heater is proposed for melting paraffin deposits formed in borehole columns filled with borehole liquid. The heater includes an inductor joined essentially with a control module enclosing electronic components. The inductor includes a non-metallic protective cover enclosing particularly an induction coil heating up a heating rod with a tip that melts paraffin deposits. The protective cover provides free propagation of HF-magnetic field created by the coil, which also heats up the column's walls melting paraffin thereon. An internal cavity is formed particularly by surfaces of the protective cover, tip, induction coil, etc., and communicates with an elastic compensator. The cavity is filled with liquid filler allowing the inductor to withstand high pressure of the borehole liquid. Surplus of the filler formed in the cavity due to volumetric temperature expansion flows essentially into the compensator. Embodiments envisage regulating the heater's temperature, and operating the inductor at a resonance frequency.

8 Claims, 10 Drawing Sheets

(56) References Cited

U.S. PATENT DOCUMENTS 7,121,342 B2 * 10/2006 Vinegar ..... E21B 36/04 166/302
7,172,038 B2 * 2/2007 Terry ..... G01V 3/30 175/45
7,363,979 B2 * 4/2008 Hill ..... E21B 36/04 166/302
7,370,704 B2 * 5/2008 Harris ..... E21B 36/04 166/302
7,405,358 B2 * 7/2008 Emerson ..... H02G 15/18 174/88 R
7,461,691 B2 * 12/2008 Vinegar ..... E21B 43/24 166/60
7,543,643 B2 * 6/2009 Hill ..... E21B 36/04 166/302
7,563,983 B2 * 7/2009 Bryant ..... H02G 7/04 174/74 R
7,730,936 B2 * 6/2010 Hernandez-Solis .... E21B 36/04 166/60
7,798,220 B2 * 9/2010 Vinegar ..... E21B 36/04 166/272.3
8,146,669 B2 * 4/2012 Mason ..... H01J 37/32926 166/378
8,225,866 B2 * 7/2012 de Rouffignac ..... E21B 36/04 166/250.01
8,257,112 B2 * 9/2012 Tilley ..... H01R 13/41 439/586
8,327,932 B2 * 12/2012 Karanikas ..... E21B 43/243 166/251.1
8,485,256 B2 * 7/2013 Bass ..... E21B 36/04 166/302
8,857,051 B2 * 10/2014 Burns ..... E21B 17/028 29/868
8,943,686 B2 * 2/2015 Hartford ..... H01R 13/533 29/869
9,048,653 B2 * 6/2015 D'Angelo, III ..... H02G 15/18
9,080,409 B2 * 7/2015 Craney ..... E21B 36/04
9,466,896 B2 * 10/2016 Harmason ..... H01R 4/70
9,839,075 B1 * 12/2017 Sokryukin ..... H05B 6/105
10,645,762 B2 * 5/2020 Elserman ..... H05B 6/36
2002/0028070 A1 * 3/2002 Holen ..... F24H 1/105 392/478
2003/0098149 A1 * 5/2003 Wellington ..... E21B 43/24 166/52
2003/0146002 A1 * 8/2003 Vinegar ..... E21B 43/247 166/384
2003/0196789 A1 * 10/2003 Wellington ..... E21B 43/305 166/64
2004/0104045 A1 * 6/2004 Larovere ..... E21B 33/14 175/16
2004/0149443 A1 * 8/2004 La Rovere ..... E21B 33/14 166/302
2006/0289536 A1 * 12/2006 Vinegar ..... E21B 43/12 219/772
2007/0127897 A1 * 6/2007 John ..... C10G 1/002 392/301
2009/0071646 A1 * 3/2009 Pankratz ..... E21B 36/04 166/265
2009/0260824 A1 * 10/2009 Burns ..... E21B 19/08 166/302
2010/0089584 A1 * 4/2010 Burns ..... H01C 3/00 166/302
2010/0258265 A1 * 10/2010 Karanikas ..... E21B 36/04 165/45
2011/0134958 A1 * 6/2011 Arora ..... E21B 43/295 374/136
2011/0247805 A1 * 10/2011 De St. Remey .... E21B 43/2401 166/272.1
2011/0247816 A1 * 10/2011 Carter, Jr. ..... E21B 7/28 166/298
2011/0248018 A1 * 10/2011 Bass ..... E21B 43/2401 219/544
2012/0039358 A1 * 2/2012 Bosselmann ..... G01K 1/08 374/161
2012/0084978 A1 * 4/2012 Hartford ..... H01R 13/533 29/869
2012/0085564 A1 * 4/2012 D'Angelo, III ..... H02G 1/14 174/13
2012/0255772 A1 * 10/2012 D'Angelo, III ..... H02G 15/18 174/75 R
2013/0167872 A1 * 7/2013 Weston ..... A61L 2/04 134/18
2014/0246193 A1 * 9/2014 Wollen ..... E21B 47/07 166/252.1
2015/0292299 A1 * 10/2015 Blendinger ..... E21B 17/1078 166/285
2016/0265325 A1 * 9/2016 Sharma ..... E21B 37/00
2017/0094726 A1 * 3/2017 Elserman ..... H05B 6/06
2017/0361501 A1 * 12/2017 van der Zalm ..... B33Y 30/00
2020/0061760 A1 * 2/2020 Haimer ..... H05B 6/38

* cited by examiner

DOWNHOLE INDUCTION HEATER

FIELD OF THE INVENTION

The present invention relates to the oil industry, in particular, to induction heaters used in production wells of paraffinic, viscous and other oils for removal of paraffin deposits.

BACKGROUND OF THE INVENTION

There is known an induction heater (patent RF 2086759, 1995), including a casing, housing and three separate induction coils (one for each phase) with three radiators. The cavity between the housing and the casing is filled with dielectric oil.

The disadvantage of that heater is the use of an expensive 3-core logging cable, an inefficient method of using eddy currents when converting electrical energy into heat and, accordingly, increased electricity consumption.

A close related art of the above device is an induction heater (patent RF 2284407, IPC E21V36/04, 37/00, 2006), containing a casing, a carrier element located coaxially with a casing with a series of induction coils placed on it, equipped with ferrite magnetic wires. In addition, the carrier element is made in the form of a conductive non-magnetic rod, the lower part of which is closed by the output coil of the last winding of the lower coil of the induction heater. The upper part of the carrier element is closed through the connector to the armor shell of the logging cable, the first winding of the upper coil is connected through the connector to the central core of the cable (CCC). The upper part of the casing is made of non-magnetic and non-conductive material, the lower part of the casing is made of magnetic and electrically conductive material, while the coil windings are wound on ferrite magnetic cores with different diameters, and the windings of the upper coil are wound on a ferrite magnetic core with a large diameter, and the windings of the lower coil are wound on a ferrite magnetic core with a smaller diameter.

An essential disadvantage of the aforementioned prior art heater is large power losses, when working at great borehole depths. For example, for borehole depth from 5000 meters or more, as well as at a low output frequency (about 1 kHz), the efficiency of the heater is significantly reduced. The use of ferromagnetic materials for manufacturing the induction coil limits the amount of current in the oscillating LC-circuit due to a low value of the saturation magnetization of ferrites.

There is known a more efficient device, which is a downhole induction heater disclosed in U.S. Pat. No. 9,839,075 issued Dec. 5, 2017, being the closest related art. It eliminates almost all the shortcomings of induction heaters described above. It also provides for protection against a negative impact of the skin effect, which reduces the conductivity of electrical connections during running of high frequency currents.

However, that device also has some structural disadvantages, and insufficient protection from the skin effect in certain parts of the high-frequency electrical connections. These disadvantages reduce the efficiency of induction heating and increases unproductive energy losses in the downhole induction heater described in U.S. Pat. No. 9,839,075.

OBJECT AND BRIEF SUMMARY OF THE INVENTION

The present invention allows solving a problem of reducing unproductive losses of electric power, conditioned by negative impact of the skin effect, and increasing the efficiency of induction heating.

The object of the invention is achieved through unique engineering solutions used in the development of structural components of the inventive induction heater in conjunction with employment of modern electronic/control components.

According to the present invention, there is proposed an induction heater being a major component of an equipment complex for removal of paraffin deposits in borehole columns of production oil wells, while the borehole column is filled with borehole liquid under pressure developed therein at significant depths of several kilometers of oil wells. The induction heater is immersed into the borehole column and electrically powered substantially from a standard power supply source.

The induction heater includes an inductor joined essentially with a control module enclosing electronic components. The inductor includes a non-metallic protective cover enclosing particularly an induction coil that heats up a heating rod with a tip, which tip melts the paraffin deposits located immediately below the tip. The non-metallic protective cover also provides for free propagation of HF-magnetic field created by the induction coil, while the HF-magnetic field additionally heats up the column's walls melting paraffin thereon. An internal cavity is formed particularly by certain surfaces of the protective cover, the tip, the induction coil, etc. (see explanation below). The internal cavity communicates with an elastic compensator via a hollow channel. The internal cavity is filled with a liquid filler with suitable electric insulation properties and allowing the inductor to withstand high pressure of the borehole liquid developed inside the borehole column. A surplus of the liquid filler formed in the internal cavity due to volumetric temperature expansion flows into the compensator via the hollow channel. Certain embodiments of the proposed invention envisage regulating the heater's temperature, the rate of downward passage of sections of the borehole column, and operating the inductor at a resonance frequency. Preferred materials and configurations of certain components of the invention are also disclosed herein.

BRIEF DESCRIPTION OF DRAWINGS OF THE INVENTION

Figure 6:
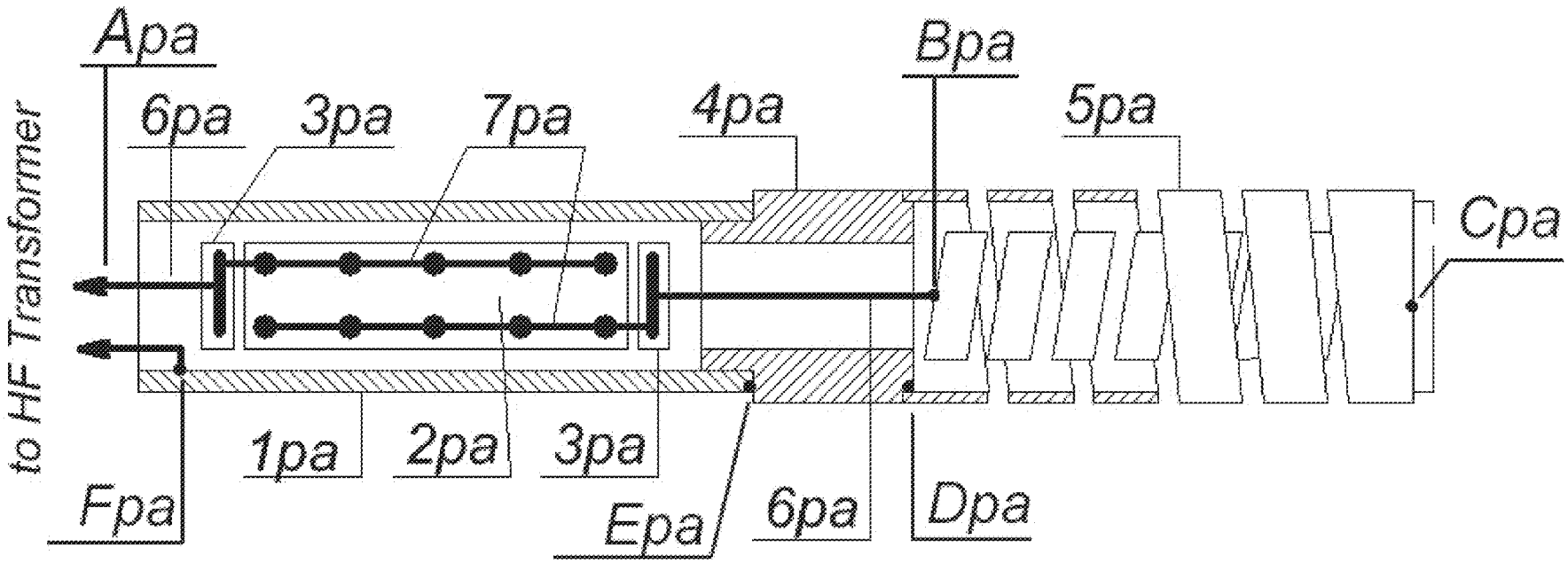
Fig. 6 Prior Art

FIG. 6 "Prior Art" illustrates a longitudinal cross-section of high-frequency part of the induction heater taught by U.S. Pat. No. 9,839,075.

Figure 7:
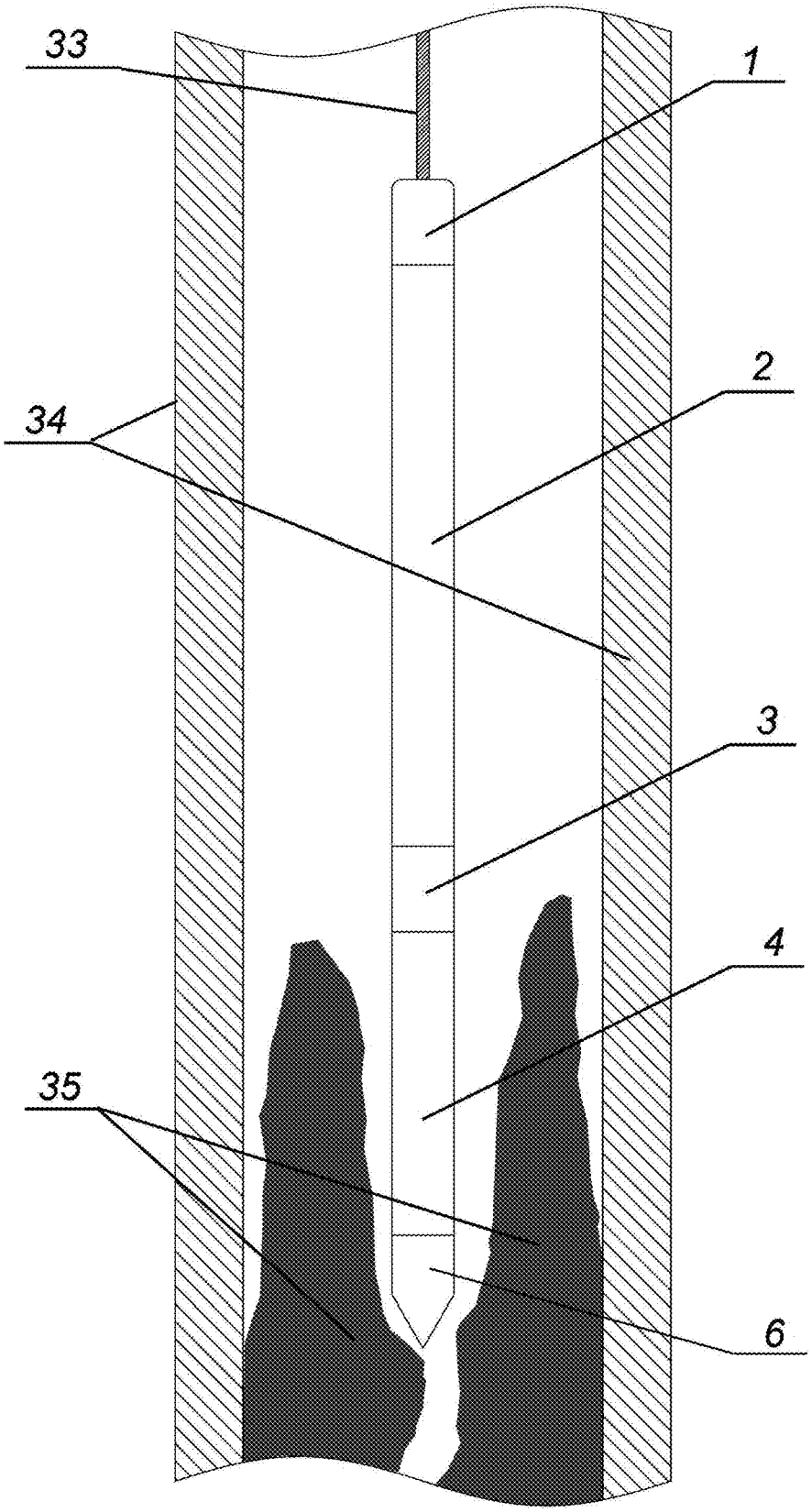

FIG. 7 illustrates a longitudinal cross-section of a borehole column of an oil well with the induction heater immersed thereinto, and paraffin deposits (clots) in the oil well, according to a preferred embodiment of the invention.

Figure 8:
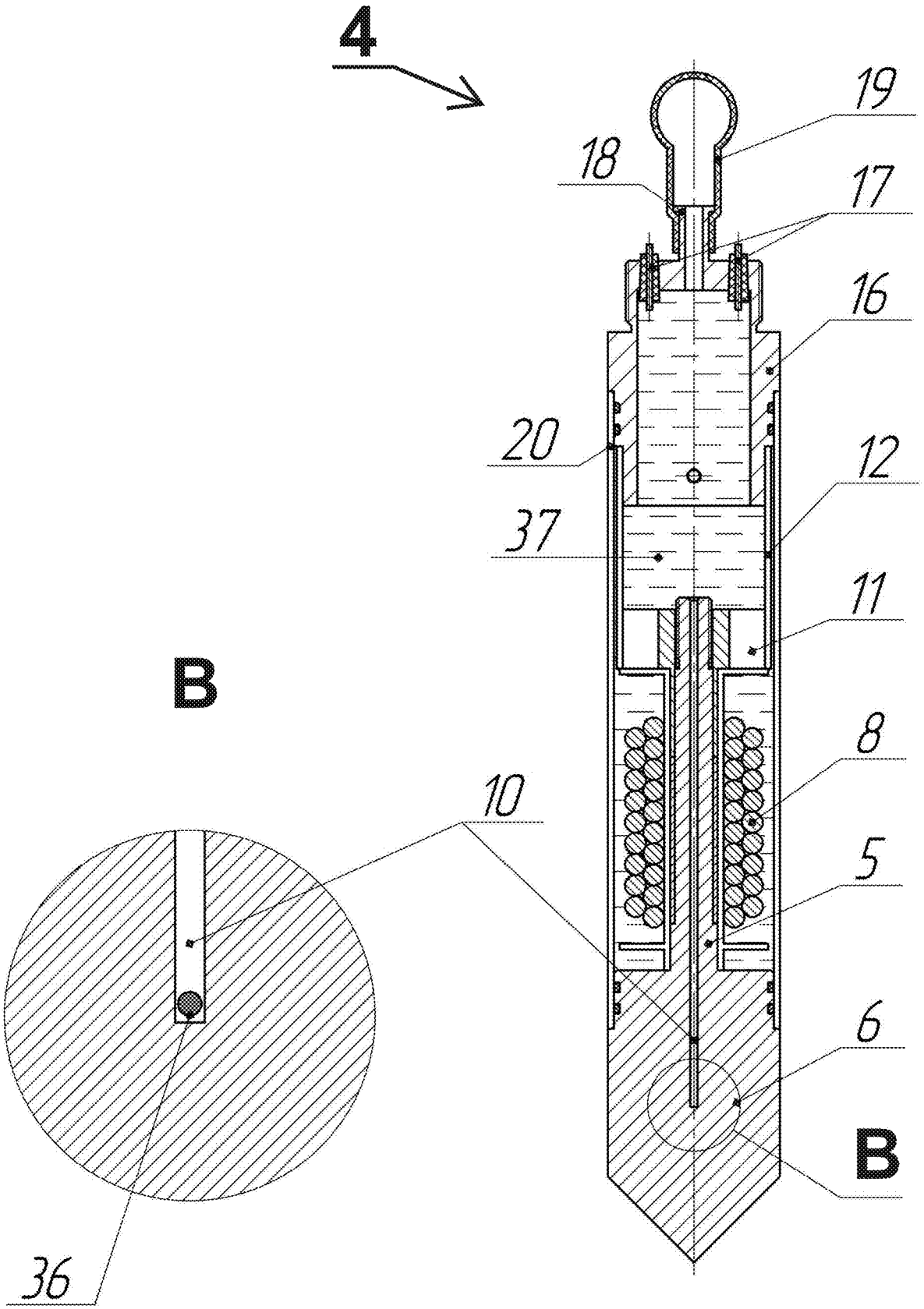

FIG. 8 illustrates the detailed arrangement of components enclosed in the inductor (in a longitudinal cross-section), specifically showing an internal cavity filled with silicon-organic liquid and a temperature sensor inside the inductor, according to a preferred embodiment of the invention.

Figure 9:
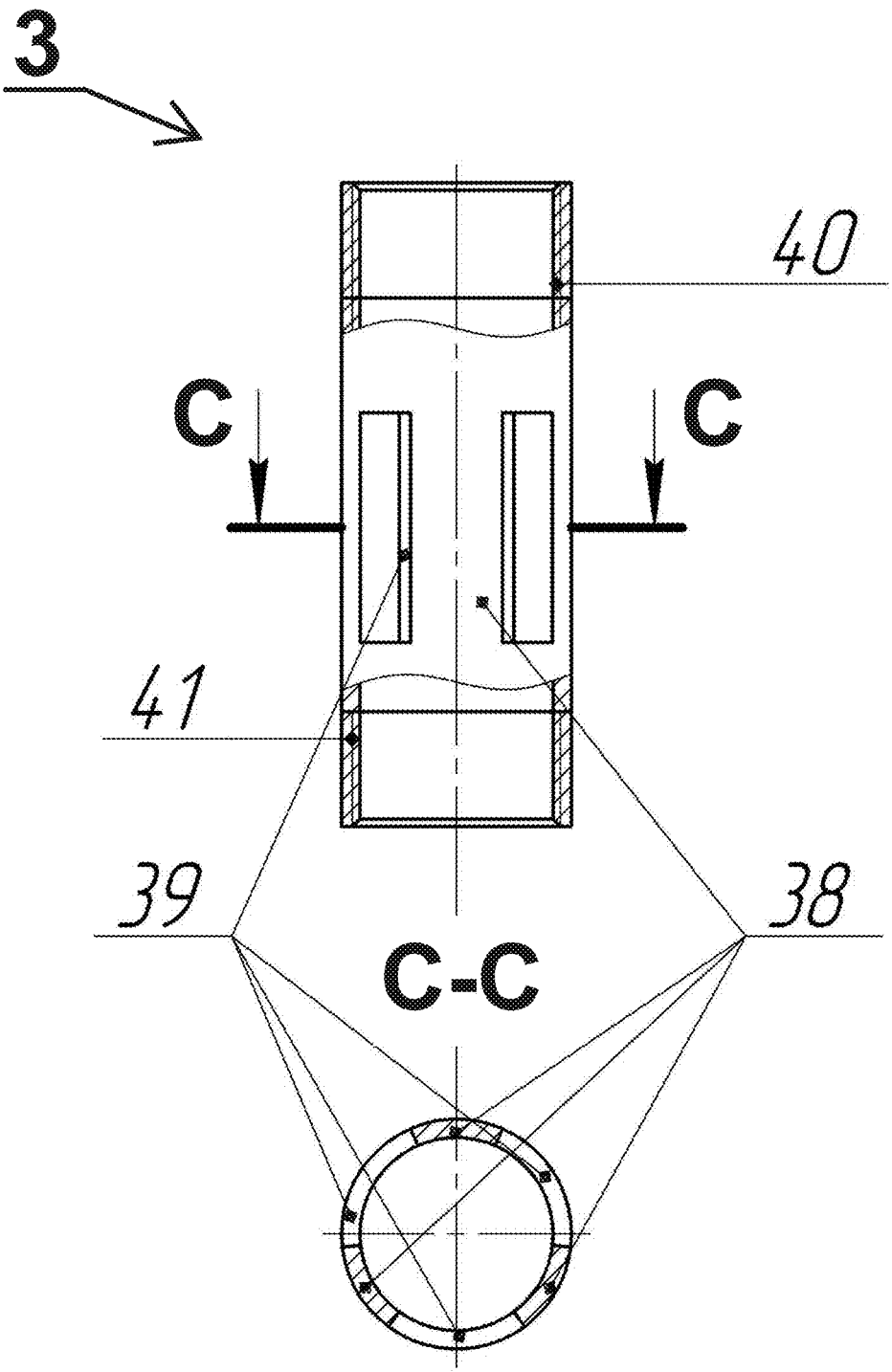

FIG. 9 illustrates the detailed arrangement of the coupling (in a longitudinal cross-section), according to a preferred embodiment of the invention.

Figure 10:
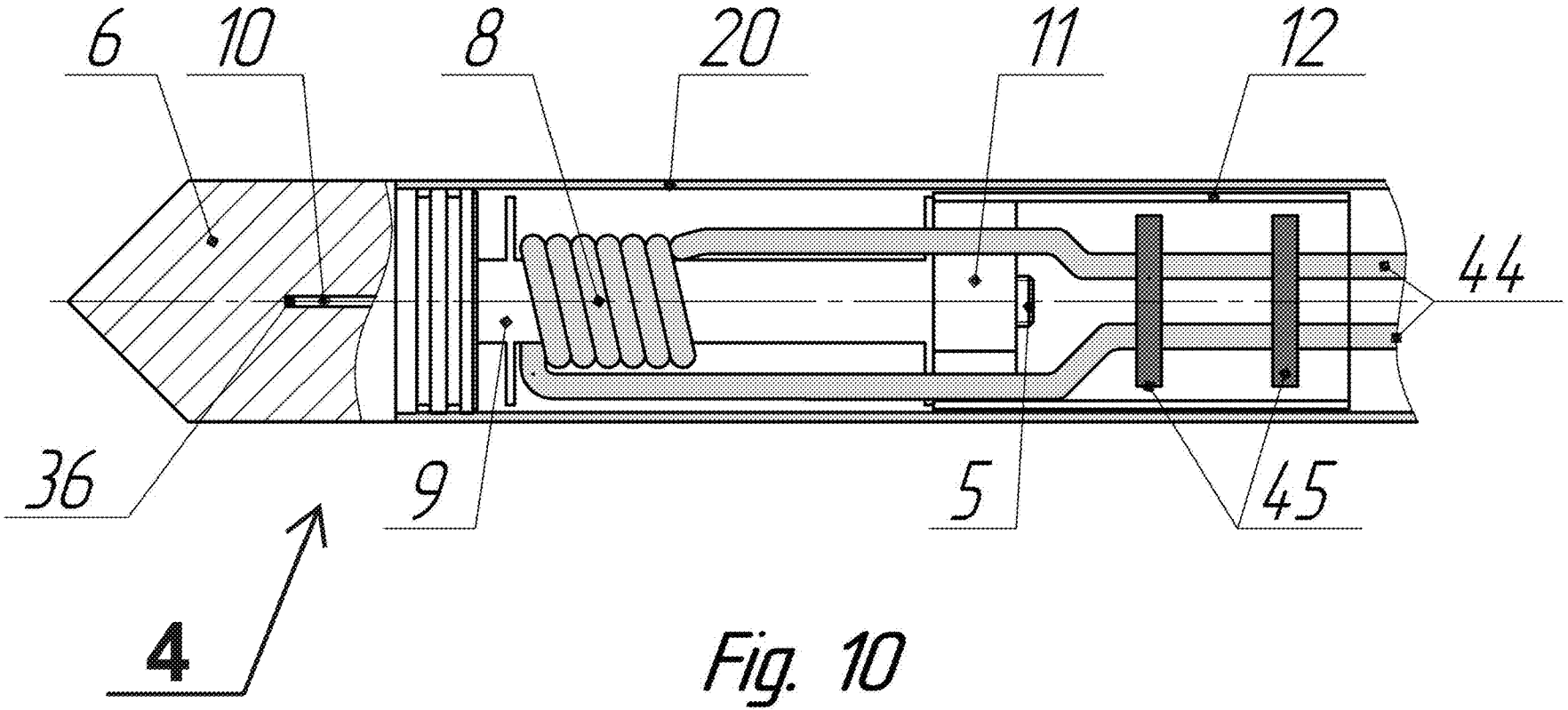

FIG. 10 illustrates a longitudinal cross-section of a portion of the inductor, particularly depicting an internal arrangement of the induction coil and its extension along with other components of the inductor, according to a preferred embodiment of the invention.

DETAIL DESCRIPTION OF PREFERRED EMBODIMENTS OF THE INVENTION

While the invention may be susceptible to embodiment in different forms, there are described in detail herein below, specific embodiments of the present invention, with the understanding that the instant disclosure is to be considered an exemplification of the principles of the invention, and is not intended to limit the invention to that as described herein.

According to a preferred embodiment of the present invention, an equipment complex for removal (melting) of paraffin deposits in production oil wells (specifically, in borehole columns) includes an induction heater.

Figure 1:
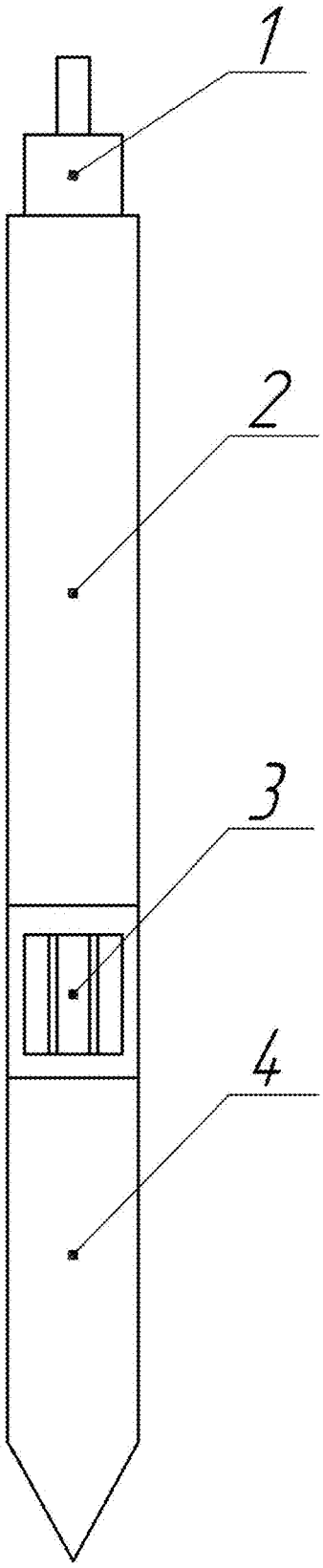
FIG. 1 illustrates a general view of an induction heater comprising four modules: a heater head; a control module enclosed in a housing, containing the control module's components; a coupling; and an inductor, according to a preferred embodiment of the invention.

FIG. 1 illustrates a general view of the inventive induction heater preferably assembled of four modules:

- a heater head 1 (serving for connection with a power supply cable electrically feeding the induction heater; described below);
- a control module 2 enclosed in a protective housing (shown and numbered 30 in FIG. 3), particularly enclosing electronic components of the control module 2 (in detail described below), while the control module 2 is attached to the heater head 1;
- an inductor 4 (the module that actually does melting of paraffin deposits; in detail described below); and
- a coupling 3 designed to join the control module 2 with the inductor 4 (in detail described below).

The inductor 4 (in detail shown in FIGS. 2, 8 and 10) is preferably composed of:

- a heating rod 5. It is designed to transfer thermal energy from the heating element (numbered 7 below) to the tip (numbered 6 below) of the heating rod 5.
- a tip 6 of the heating rod 5. It carries out the melting of a paraffin clot formed inside the borehole column.
- a heating element 7. It is a source of thermal energy, which is transmitted by the heating rod 5 to the tip 6.
- an induction coil 8. It is a source of a powerful high-frequency magnetic field (herein also called "HF magnetic field"). It is shown in FIGS. 2, 5, 8 and 10. The induction coil 8 is preferably made of enameled copper wires in the form of harness. The same harness form is preferably used for most electrical connections of the inductor's components, which reduces negative impact of the skin effect to a minimum. Factually, the winding of the induction coil 8 is a first part of a wire harness, which preferably consists of 350 enameled copper wires having a diameter of 0.4 mm.
- an induction coil extension 44 (shown in FIG. 10). The induction coil extension 44 is a second part of the aforementioned wire harness, whose first part is represented by the winding of induction coil 8 (see above).
- a number (preferably two) of brackets 45 (shown in FIG. 10) fixing the induction coil extension 44 to the walls of the passage bushing (numbered 12 below).
- an induction coil frame 9. It is designed to accommodate winding turns of the induction coil 8 and protect it (i.e. thermally insulate) from high temperature developed in the heating element 7.
- a temperature signal channel 10. It is particularly designed to transmit temperature signals from the temperature sensor (numbered 36 below, see also FIG. 8) to the CPU (or control circuitry, numbered 27 below); and after processing by the CPU, it's transmitted via the telemetry unit (numbered 42 below) and the power cable (numbered 33 below) to the ground station (numbered 32 below).
- a connector assembly 11. It is designed for mechanical connection of the heating rod 5 to the passage bushing (numbered 12 below).
- a passage bushing 12. It is designed to accommodate the induction coil extension 44, and to fix it therein by means of brackets (numbered 45 below, see FIG. 10). The passage bushing 12 is preferably formed of a brass tube with sidewalls preferably 2 mm thick. In preferred embodiments, the tube is longitudinally cut into two half-tubes mounted inside the protective cover (numbered 20 below).
- an inductor cap 16. It is joined with the passage bushing 12; and, on its top, it accommodates the inductor contact group (numbered 17 below) and the hollow channel (numbered 18 below) for filling a liquid filler (see below) into the inductor 4; it also serves for mechanical connection of the inductor 4 with the coupling 3.
- an inductor contact group 17. It preferably consists of ten sealed electrical contacts for connecting electrical circuits of the inductor 4 to the control module contact group (numbered 23 in FIG. 3; see below) located in the control module 2. It's mounted on the top surface of the inductor cap 16.
- a hollow channel 18 for filling the liquid filler into the inductor's internal cavity (numbered 37 below). It provides for filling in the internal cavity with the liquid filler, preferably with silicon-organic liquid.
- a compensator 19. It is an elastic hollow vessel, made preferably of oil-resistant rubber capable of withstanding action of organic solvents. It serves as a compensation container for the liquid filler flowing out of the inductor 4 when heated up by the tip 6, due to volumetric temperature expansion (see also explanation below).
- a protective cover 20 of the inductor 4. Together with other structural elements (see explanation below), it forms the inductor's internal cavity (numbered 37 below, and shown in FIG. 8) used for filling the filler (preferably, silicon-organic liquid) in. The protective cover 20 is preferably made of a polymer material to provide free propagation of the HF magnetic field created by the inductor coil 8. This allows heating up (and melting) not only paraffin deposits located immediately under the tip 6, but also paraffin deposits stuck to the internal sidewalls (below numbered 34, see FIG. 7) of the borehole column. A high-temperature polymer ZX750-V5T produced by ZEDEX company, which can withstand heat up to 320° C., is chosen as the preferable material for the protective cover 20.

a number of sealing rings 21 (preferably made of suitable rubber). They prevent leakage of the liquid filler from the inductor's internal cavity (numbered 37 below).

Figure 3:
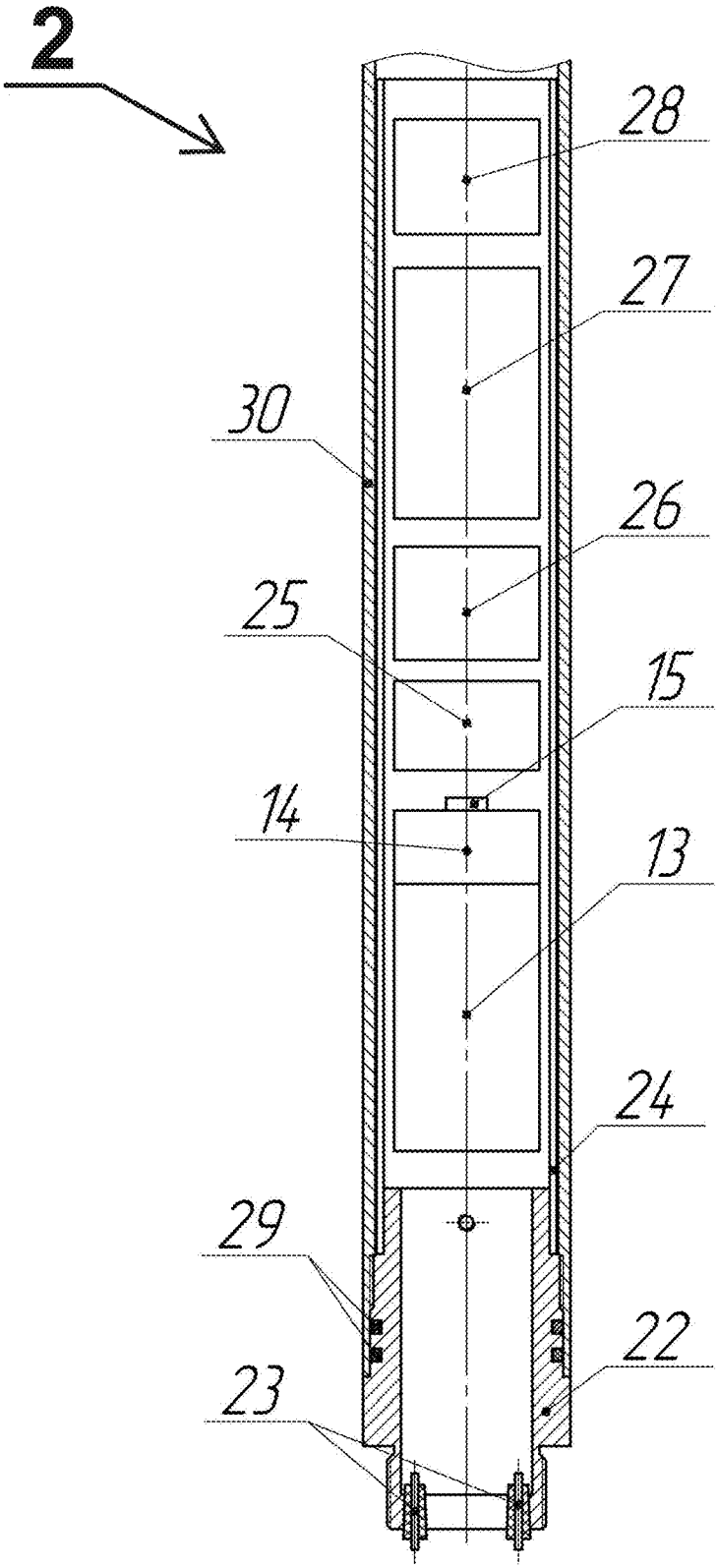
FIG. 3 illustrates the detailed arrangement of components enclosed in the control module (in a longitudinal cross-section), according to a preferred embodiment of the invention.
Figure 4:
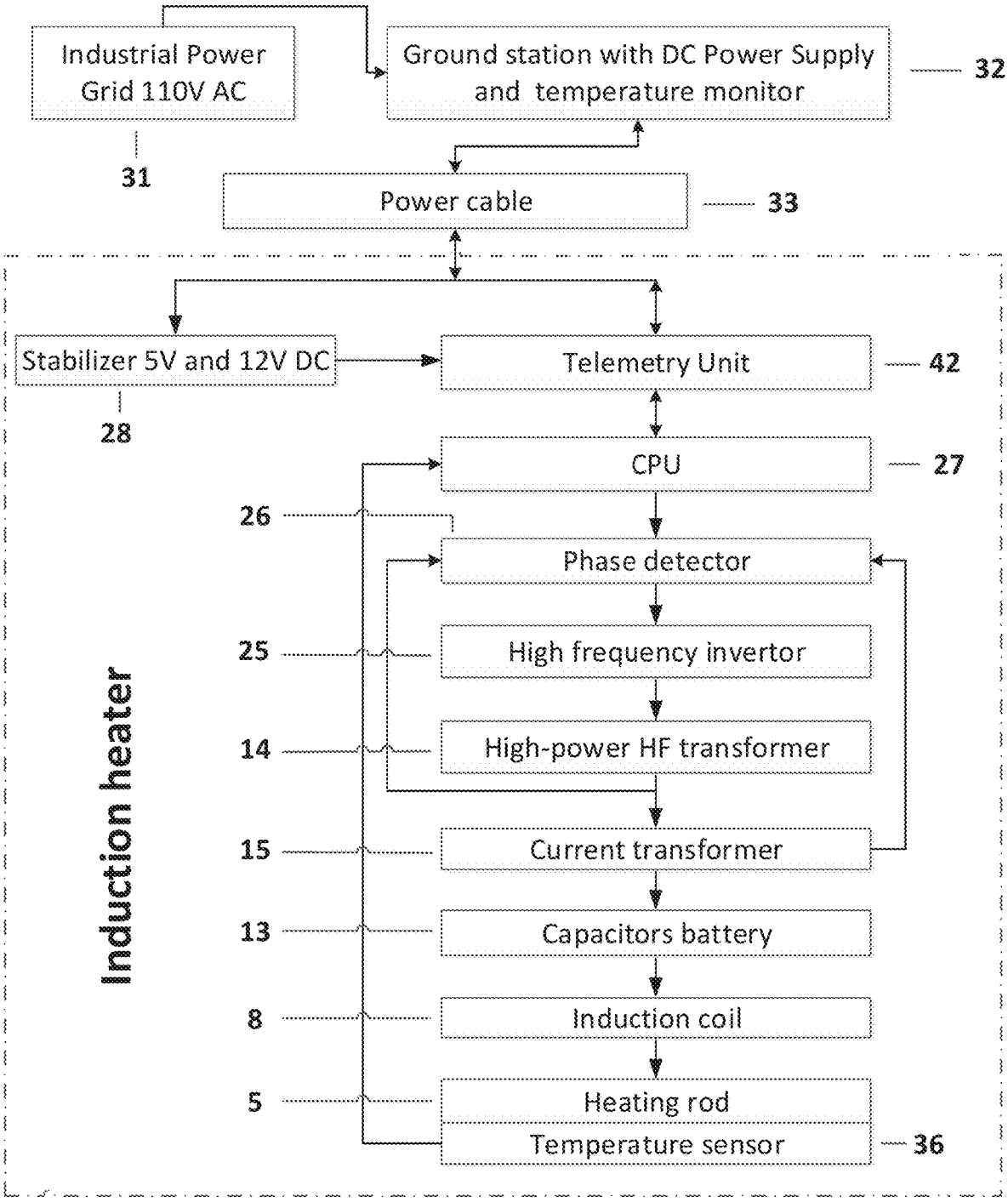
FIG. 4 illustrates a functional diagram of a hardware complex for the removal of paraffin deposits in oil wells, according to a preferred embodiment of the invention.
Figure 5:
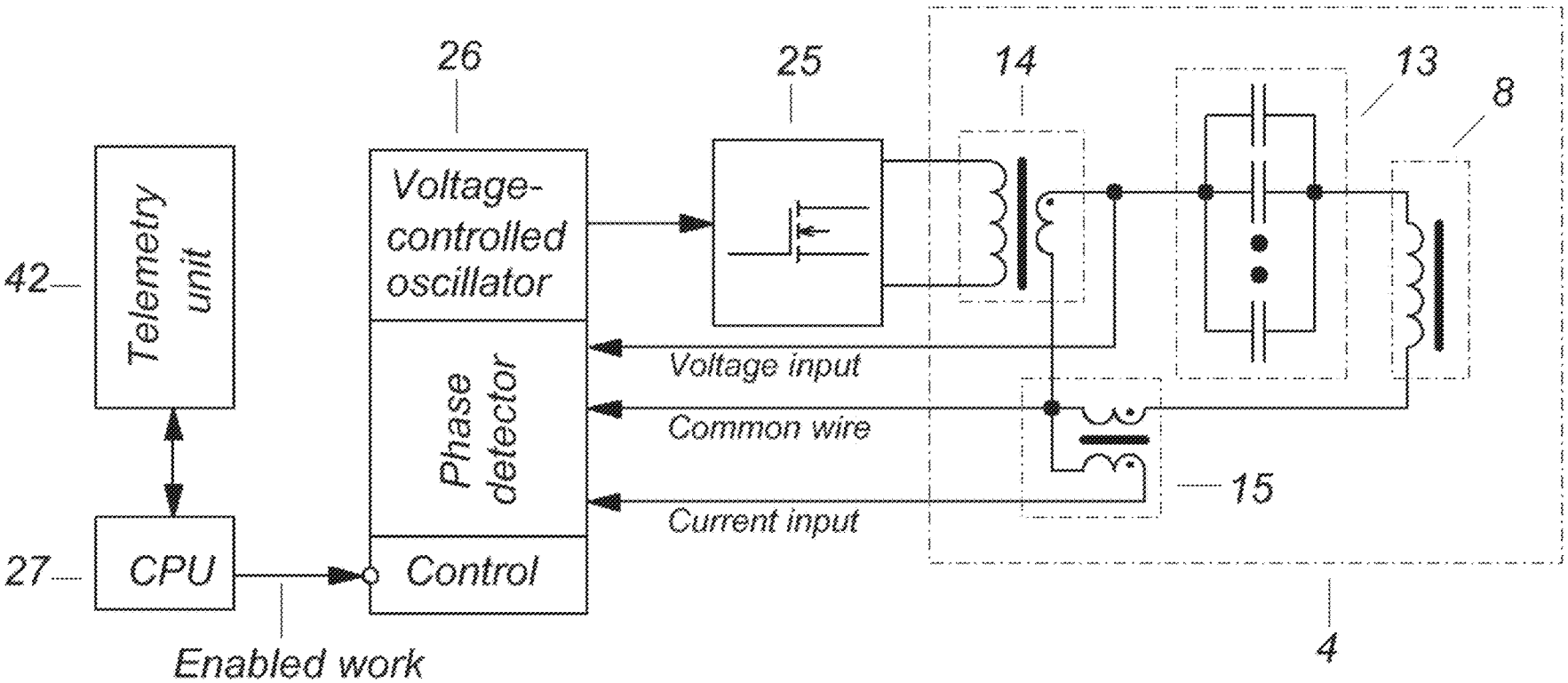
FIG. 5 illustrates an electric block-schema with a fragment of circuitry of the induction heater, according to a preferred embodiment of the invention.

The control module 2 (in detail is shown in FIG. 3) preferably comprises:

a lower bushing 22. It is designed for mechanical attachment of the control module 2 with the coupling 3 that is further attached to the inductor cap 16 (part of the inductor 4). The lower bushing 22 is located in the lower portion of the control module 2 (see FIG. 3).

a control module contact group 23. It preferably consists of ten sealed electrical contacts to connect the electronic circuits of the control module 2 to the inductor contact group 17 (see above) located in the inductor 4. The control module contact group 23 is mounted at the bottom of the lower bushing 22.

a container 24. It is designed to accommodate (fix) electric/electronic components or circuit boards (described below) of the control module 2 (particularly, see FIG. 5). Similar to the passage bushing 12, the container 24 is preferably formed of a brass tube with sidewalls preferably 2 mm thick. In preferred embodiments, the tube is longitudinally cut into two half-tubes mounted inside the protective cover (numbered 20 above).

a capacitor battery 13. It forms a series oscillating LC-circuit together with the induction coil 8. It is also shown in FIG. 5.

a high-frequency transformer 14 (herein also called "HF-transformer"). It receives voltage pulses from the high-frequency inverter (numbered 25 below, see FIG. 4) to power the series LC-circuit. It is also shown in FIG. 5.

a current transformer 15. It is designed to measure electric current of the series LC-circuit. It is also shown in FIG. 5.

a high-frequency inverter 25 (herein also called "HF-inverter"). It is designed to generate high-power voltage pulses applied to the high-frequency transformer 14 (see above). It is also shown in FIG. 5. The high-frequency inverter 25 incorporates powerful transistors (preferably of the MOSFET type) and a cooler (radiator—not shown) of the transistors (not shown).

a phase-locked loop (PLL) 26. It is designed to generate pulse voltage and tune its frequency to a resonance frequency of the series oscillating LC-circuit of the inductor 4 (composed of the induction coil 8 and the capacitor battery 13—see above). The PLL 26 includes an internal "Voltage-controlled oscillator" and "Phase detector" (shown in FIG. 5). It is also shown in FIG. 5, in connection with other electronic components of the control module 2. This circuit-based solution provides automatic tuning of the resonant frequency of the series LC-circuit, depending on changing external conditions (see explanation below).

a CPU 27 (herein also called "control circuitry"), shown in in FIGS. 3-5. It controls the PLL 26 and organizes the telemetry unit (numbered 42 below) to transmit telemetry information to the operator performing work to melt paraffin deposits in the oil well. It is also shown in FIG. 5. The CPU 27 incorporates a microprocessor (preferably the Atmel AtTyni2313 type microprocessor) furnished with long-term memory.

a voltage regulator 28 (also called "Stabilizer 5V and 12V DC" in FIG. 4). It is used for power supply of the electronic components of the control module 2.

a number of sealing rings 29 (preferably made of suitable rubber). They prevent penetration of the borehole fluid into the control module 2 via threaded connections of the coupling 3 (see explanation below). The sealing rings 29 hermetically seal the mechanical connection of the lower bushing 22 with the threading connection (numbered 40 below and shown in FIG. 9, see also explanation below) of the coupling 3.

a housing 30. It's a hermetic hollow container, preferably having a cylindrical shape deemed more suitable for the housing, though another type of shape can be used in specific embodiments of the invention. It provides for protection of electronic circuits (see above) of the control module 2 from damaging factors when operating in aggressive environments, such as oil wells. The lateral surface of the housing 30 is made of solid material (preferably a suitable metal) sufficiently firm to withstand significant pressure of the borehole liquid, developed in depths of several kilometers in the oil production well.

Figure 2:
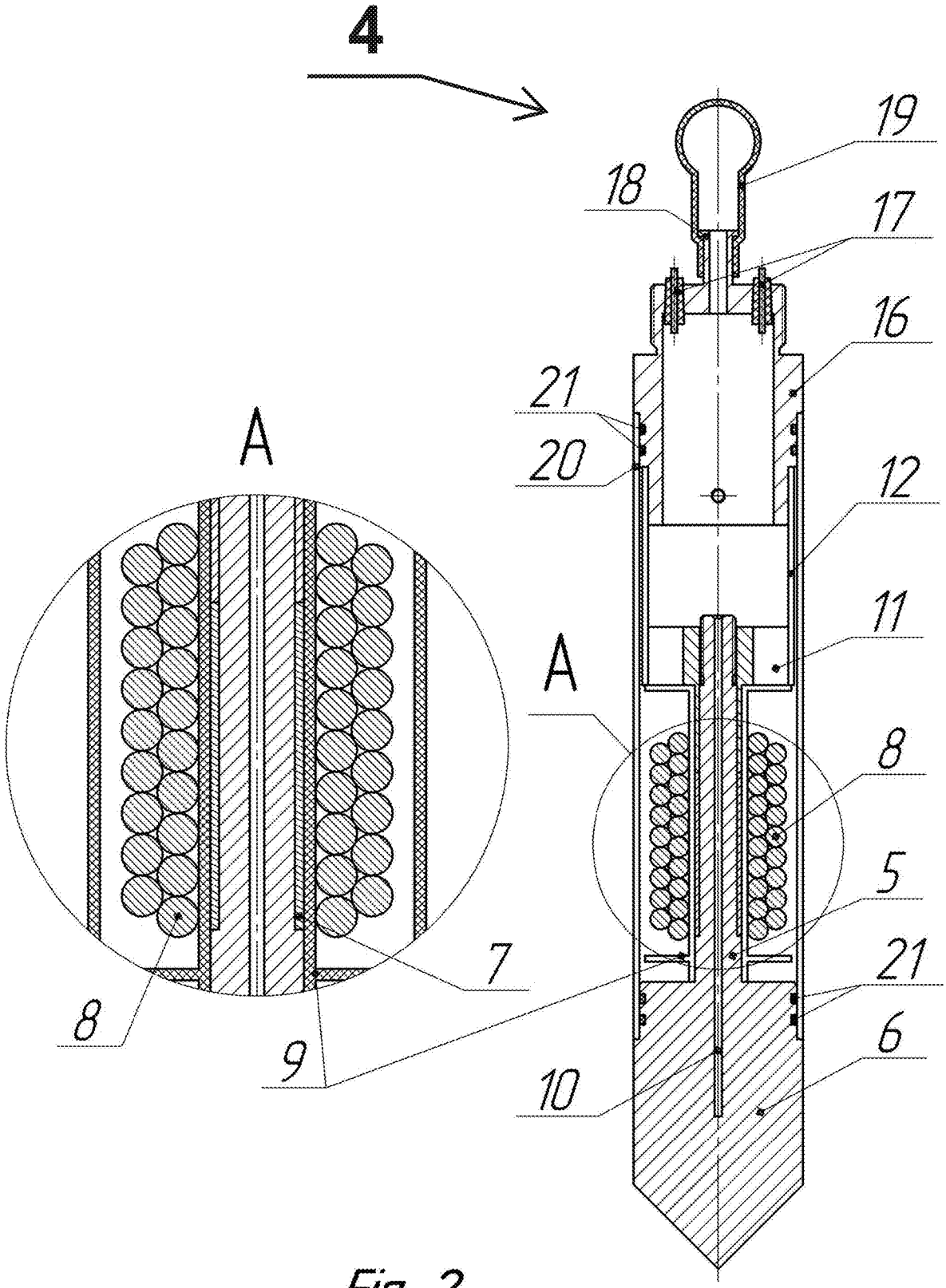
FIG. 2 illustrates the detailed arrangement of components enclosed in the inductor (in a longitudinal cross-section), according to a preferred embodiment of the invention.

A functional diagram of the equipment complex for removal of paraffin deposits in borehole columns of production oil wells is shown in FIG. 4. It includes:

an industrial power grid 31 (typically of 110V AC voltage). It is a source of energy necessary for operation of the equipment complex.

a ground power station 32, converting AC voltage received from the industrial power grid 31 into DC voltage for power supply of the inventive downhole induction heater. It includes a 2000 W DC power supply and a LED indicator indicating temperatures of the tip 6 and the cooler of transistors of the high-frequency inverter 25. The ground power station 32 also incorporates a microprocessor, preferably with Manchester II code, which is part of ground operating means that also include a computer control program. Control of the induction heater is preferably performed by the AtTyni2313 microprocessor made by Atmel.

a power cable 33 (preferably a single core logging cable). It is designed to supply power from the ground power station 32 to the induction heater. It is also a channel for transmitting telemetry information from the CPU 27 via the telemetry unit (numbered 42 below, see FIGS. 4-5) to the ground station 32.

a telemetry unit 42 (also shown in FIG. 5). It's a microchip that is preferably incorporated with the CPU 27 in a common electronic block. Its function is at least to encode temperature signals processed by the CPU 27 (which receives the temperature signals from the temperature sensor 36 via the temperature signal channel 10), and to transmit the encoded signals through the cable 33 to the ground station 32 for further processing by the ground operating means employed by the operator.

the components numbered 5, 8, 13-15, 25-28, 36 are described herein above and below (the same components are also shown in FIGS. 2, 3 and 8).

A fragment of circuitry of the induction heater is shown in FIG. 5. It includes the following components (also shown in FIGS. 2-4): the CPU 27; the telemetry unit 42, the PLL 26 (including the "Voltage controlled oscillator" and "Phase detector"); the high-frequency inverter 25; and a portion of the inductor 4 including: the capacitor battery 13, the induction coil 8, the high-frequency transformer 14, and the current transformer 15. A method of its operation is described in detail below.

FIG. 6 "Prior Art" shows the design of high-frequency part of the induction heater taught by U.S. Pat. No. 9,839,075. It includes: a container 1*pa*; a capacitor bank 2*pa*;

electrical contacts 3*pa* of the capacitor bank; a coupling 4*pa*; an inductor 5*pa*; a multi-core connector 6*pa* connecting a high-frequency transformer (not shown) to the capacitor bank 2*pa*, and connecting the capacitor bank 2*pa* to the inductor 5*pa*; a flexible flat cable 7*pa* made of several strips of brass foil, providing for parallel connection of capacitors of the capacitor bank 2*pa*.

FIG. 7 depicts the longitudinal cross-section of a borehole column used for oil production, with the induction heater immersed into the borehole column, and paraffin clots (deposits), wherein there are shown: the borehole column with its walls 34; paraffin clots 35; the logging cable 33 (also shown in FIG. 4); components 1-4 and 6 described herein above (also shown in FIGS. 1-2).

FIG. 8 illustrates, in a longitudinal cross-section, the detailed arrangement of components enclosed in the inductor 4.

FIG. 8 specifically shows a temperature sensor 36 located inside of the inductor 4. It's placed in the central area of the tip 6. The temperature sensor 36 is necessary for measuring the temperature of the tip 6 and controlling the power of induction heating. Electrical connection of the temperature sensor 36 with electronic components of the control module 2 is provided via the temperature signal channel 10, the inductor contact group 17, and the control module contact group 23 (see also FIGS. 2-4).

FIG. 8 also shows an internal cavity 37 essentially located within the protective cover 20 and filled with a liquid filler, preferably silicon-organic liquid (having suitable electrical insulating properties), according to a preferred embodiment of the invention.

Specifically, the internal cavity 37 is formed essentially by the following elements: the tip 6 (its upper surface), the protective cover 20 (its inner sidewalls), the inductor cap 16 (its inner sidewalls and top surface), the hollow channel 18 (its inner surface), and the compensator 19 (its inner surface). Mechanical hardness and solidity of the inductor 4 are provided particularly by a threading connection of the heating rod 5 with the connector assembly 11; whereas the connector assembly 11 is attached by a threading connection to the lower part of inner sidewalls of the passage bushing 12 (preferably by three screws), while the upper part of inner sidewalls of the passage bushing 12 is attached by a threading connection to the inductor cap 16 (preferably by three screws).

Factually, the inventive design of the internal cavity 37 along with the compensator 19 provides, on one hand, for mechanical protection of the inductor's components against aggressive factors of environment (i.e. allows the protective cover 20 withstanding high external pressure of the borehole liquid by providing an equal pressure of the liquid filler inside the internal cavity 37). On the other hand, the inventive design allows making the protective cover 20 of a non-metal material (preferably suitable polymer, see above) providing for practically free propagation of the HF magnetic field of the inductor 4 that additionally enables heating up the internal walls 34 of the borehole column melting paraffin deposits adhered thereto. Additionally it provides for an efficient cooling arrangement using vertical convectional flows of the filler liquid inside the internal cavity 37 during its heating by the heating rod 5 and the tip 6. All these major advantages of the present invention significantly enhance operation of the inductor 4, as well as of the downhole induction heater in whole (also see explanation below).

FIG. 9 illustrates the detailed arrangement of the coupling 3, in a longitudinal cross-section, according to a preferred embodiment of the invention. The coupling 3 provides for mechanical connection of the control module 2 and the inductor 4 (see FIG. 1). The upper part of coupling 3 is attached to the lower bushing 22 of the control module 2 (see FIG. 3) by means of a threading connection 40 (shown in FIG. 9). The lower part of coupling 3 is attached to the inductor cap 16 of the inductor 4 (see FIG. 1) by means of a threading connection 41 (shown in FIG. 9). The coupling 3 includes three (preferably) windows 39 (shown in FIG. 9) made in the middle part of the coupling 3 for passing the borehole liquid to the outer surface of the compensator 19 (see explanation below). Partitions 38 (preferably three) are located between the windows 39 (see FIG. 9), providing suitable solidity of the coupling 3.

The windows 39 are necessary to pass high hydro-static pressure of the borehole liquid, developed inside the borehole column with walls 34, to the outer surface of the compensator 19, since the protective cover 20 (preferably made of polymer material—see above) cannot withstand that hydro-static pressure. On the other hand, it necessitates developing at least an equal pressure on the inner surface of the compensator 19. This condition requires that the compensator 19 be communicated with the internal cavity 37 (see explanation above, and FIG. 8), and be filled with the liquid filler capable to withstand such hydro-static pressure.

During operation of the inductor 4 (see explanation below), the liquid filler is heated up (increasing the inner pressure inside the compensator 19) and expands (due to volumetric temperature expansion) into the inner space of the compensator 19, thereby equalizing the outer hydro-static pressure of borehole liquid by the inner pressure inside the compensator 19.

FIG. 10 illustrates a longitudinal cross-section of a portion of the inductor 4, depicting an internal arrangement of the induction coil 8 and the induction coil extension 44 along with other components of the inductor, according to a preferred embodiment of the invention.

The induction coil extension 44 connects the induction coil 8 with the inductor contact group 17 and subsequently with the control module contact group 23 (see FIG. 3), which are further connected (see explanation above) with the capacitor battery 13 (see FIG. 3), the HF transformer 14 (see FIG. 3), and the current transformer 15 (see FIG. 3).

The brackets 45 fix the induction coil extension 44 to the walls of the passage bushing 12. The brackets 45 are preferably made of a suitable polymer material.

Operation of the Invention

According to preferred embodiments of the invention, operation of the induction heater as part of the aforesaid equipment complex is carried out as follows. The microprocessor, being part of the CPU 27 (see above) includes long-term memory, which stores a pre-installed computer program. When electric power is supplied from the ground station 32 to the induction heater, the computer program starts executing. The computer program instructs to measure the temperature in the central area of the tip 6 and the temperature of the cooler of transistors of the high-frequency inverter 25, which measurements represent telemetry information. The CPU 27 processes the telemetry information, sends it to the telemetry unit 42 that encodes it, preferably with Manchester II code, thereby obtaining telemetry information, and transmits the telemetry information via the power cable 33 (see FIG. 4) to the ground station 32 for further processing by the ground operating means.

The other microprocessor with Manchester II code (being part of the ground operating means) of the ground station 32 decodes the telemetry information and outputs information to the LED display. The temperature values allow the operator, using the ground operating means, for assessing operability of the induction heater and adjusting the speed of passage of the borehole column's sections downward the oil well containing paraffin deposits (see also FIG. 7).

If the temperature of tip 6 drops below 95° C., the rate of paraffin deposits penetration should be reduced, if the temperature exceeds 110° C., the ground operating means automatically reduce the supply voltage of the induction heater by 5% every 2 minutes to establish the temperature of the tip 6 in the range of 95-110° C.

An important task in designing the induction heater is to ensure operation of the series LC-circuit, formed by the induction coil 8 and the capacitor battery 13, at its resonant frequency. In this mode, the series LC-circuit has a close to zero reactance and, therefore, a close to zero of inefficient reactive power. At that, the efficiency of induction heating reaches its maximum value.

FIG. 5 shows the functional diagram of the induction heater, which provides the most accurate adjustment to the resonance. The microprocessor of the CPU 27 issues an "Enabled work" signal that allows the internal oscillator of the PLL 26 to operate at a frequency value $F_0$. The frequency of the internal oscillator is controlled by voltage, so it is called "Voltage-controlled oscillator" (see FIG. 5) or VCO. The frequency value $F_0$ is determined by circuitry components of the PLL 26, and is to be in the range of 105-110 kHz.

Pulse voltage with the frequency $F_0$ is amplified by power with the high-frequency inverter 25 and the high-frequency transformer 14, and is then supplied to the series LC-circuit.

In the circuit, forced harmonic oscillations arise and electric current flows therethrough. Voltage from the input of the series LC-circuit and a resistor (not shown) from the secondary side of the current transformer 15 proportional to the electric current flowing through the series LC-circuit are fed to the phase detector (preferably, the Texas Instruments chip CD4046BE) of the PLL 26.

The phase detector converts a phase angle of incoming signals into voltage. The sign of the voltage depends on whether the voltage at the input of the series LC-circuit is behind or ahead of the current flowing therethrough. The voltage of the phase detector adjusts the frequency of the VCO so that the angle of phase shift between the current and voltage signals is close to zero, and thus the operating condition of the series LC-circuit at the resonant frequency is satisfied.

The impedance of a series LC-circuit is calculated by the following formula:

$$Z = \sqrt{R^2 + \left(\omega \times L - \frac{1}{\omega \times C}\right)^2},$$

wherein: R is the active resistance of the series LC-circuit, $\omega \times L$ is the inductive resistance, $$\frac{1}{\omega \times C}$$

is the capacitive resistance, $\omega$ is the natural or cyclic frequency of the voltage applied to the series LC-circuit.

In turn, $\omega = 2 \times \pi \times f$, where f is the frequency of the voltage applied to the series LC-circuit. It can be seen from the formula that when the inductive and capacitive resistance of the components of the series LC-circuit are equal, its impedance is equal to the active resistance of the inductor, that is, the series LC-circuit does not consume reactive power. The phase angle between current and voltage is zero. This is the condition for appearance of resonance of voltages in the series LC-circuit.

If all electrical connections in the circuit are made with a multicore conductor, then the active resistance of the circuit will be very small and amount to several thousandths of Ohm. Then even a small voltage of 1V applied to the series LC-circuit can generate currents of several hundred amperes. The energy of the magnetic field stored in the inductor is directly proportional to the square of the current flowing through the inductance. From the energy point of view, it is advantageous to increase not the coil inductance in the series LC-circuit, but the current flowing through it. Therefore, it is so important to ensure operation of the series LC-circuit at a resonant frequency.

The calculated resonant frequency of the series LC-circuit in the absence of ferromagnetic materials surrounding the inductor 4, such as the borehole column, is to be in the range of 90-100 kHz. During operation, it can vary depending on the size of the borehole column and the type of metal which they are made of, and because of heating the elements of the series LC-circuit during operation.

Usage of the proposed method of frequency tuning provides almost instantaneous, during microseconds, frequency correction and fine tuning to resonance. It should be noted that switching of high-power MOSFET transistors of the high-frequency inverter 25, when operating at a resonant frequency, occurs at a time when the current of the series LC-circuit is close to zero. This mode of operation significantly reduces heating of the MOSFET transistors to minimum values. This is an important feature, since it is not possible to apply active cooling of the powerful MOSFET transistors in the induction heater.

Other advantages (besides those mentioned herein above) of design of the inventive induction heater include:

- elimination of structural elements of the induction heater from the high-frequency series LC-circuit. Such structural elements may include: metal housing, internal support elements, such as rods, couplings and so on; and
- manufacture of the capacitor battery 13 preferably of 51 polypropylene capacitors made by WIMA, connected in parallel. Such number of capacitors are capable of providing a high-frequency current passing through the capacitor battery up to 350 A without overheating the capacitors.

FIG. 6 "Prior Art" schematically shows a fragment of an induction heater described in U.S. Pat. No. 9,839,075 issued Dec. 5, 2017, comprising a series LC-circuit formed by 2*pa* capacitor bank and 5*pa* inductor. The inductor is made of all-rolled copper and brass pipes with a spiral cut. Section Apa-Bpa has protection against the skin effect because electrical connections are made with the help of a harness 6*pa* made of several tens of enameled copper wires and a special flexible flat cable 7*pa* made of brass foil.

However, the sections Bpa-Cpa, Cpa-Dpa, Dpa-Epa, and Epa-Fpa have no protection from the skin effect, as they are made of cast copper and brass pipes (section Bpa-Cpa and Cpa-Dpa), brass coupling 4*pa* (section Dpa-Epa) and semicylindrical brass container 1*pa* (section Epa-Fpa). The thickness of the conductivity layer for the frequency of the inductor disclosed in U.S. Pat. No. 9,839,075 does not exceed 0.2 mm from the outer and inner sides of the conductive surfaces.

An important characteristic of a resonant oscillatory circuit is quality factor. The quality factor determines how many times the energy stored in the oscillation circuit is greater than the energy loss for heating conductors in a single oscillation period and is calculated by the following formula:

$$Q = \frac{1}{R} \times \sqrt{\left(\frac{L}{C}\right)},$$

where Q is the quality factor, R is the resistance of the resonant circuit, L is the inductance, and C is the capacitance of the capacitor battery.

In the proposed design of the inventive induction heater, a harness composed preferably of 350 enameled copper wires 0.4 mm in diameter is used to make the induction coil 8 and all electrical connections of the series LC-circuit.

With an active resistance value of $0.7*10^{-3}$ Ohms, an inductance of 1.2 pH and a capacitor battery's capacitance of 2.4 pF, the Q value will be 1020. As a result, the proposed design of the inventive induction heater has a significantly higher protection against negative impact of the skin effect and, consequently, greater efficiency of induction heating.

Implementation of such design of the induction heater is possible only if all elements of the inductor 4 are located in a cavity (the internal cavity 37 described above) filled with a special liquid filler. This makes it possible to protect the inductor's elements from high hydraulic pressure of the borehole fluid and mechanical damage. As noted above, silicon-organic fluid is preferably used as the filler, which has suitable electrical insulating properties.

As a result of heating the inductor's components during operation, vertically oriented convection flows of the filler are formed in the cavity of the inductor 4. They eliminate the sharp temperature gradients in the cavity of the inductor 4 and provide heat exchange with the environment through the walls of the protective casing 20. Any surplus of the filler, formed during operation of the induction heater, due to volumetric temperature expansion is neutralized (absorbed) by the compensator 19.

Thus, the VOC signal of the PLL 26 (see FIG. 5), power-amplified by the high-frequency inverter 25, causes forced oscillations in the series LC-circuit at its resonance frequency. The induction coil 8 generates a powerful HF vortex magnetic field, which, due to the Foucault currents, heats the heating element 7. The heating rod 5 transfers heat energy from the heating element 7 to the tip 6. The phase detector of the PLL 26 provides for constant monitoring of the resonance frequency in the series LC-circuit.

Schematically, the paraffin removal process is shown in FIG. 7. The tip 6 is in direct contact with the paraffin clot 35 and effectively melts it. At the same time, the high-frequency magnetic field causes vortex induction currents in the walls 34 of the borehole column and heats them up to the melting point of paraffin. Thus, removal and melting of the paraffin clot 35 occurs both inside and outside of the clot. This is an important advantage of using the inventive induction heater, since it significantly reduces operating time and, consequently, the downtime of the well.

What is claimed is:

1. An induction heater for melting paraffin deposits formed in a borehole column for oil production, said borehole column is operatively filled with borehole liquid;

said induction heater includes: a control module enclosing electronic components, an inductor, and a coupling joining the control module with the inductor; wherein said inductor comprising:

a protective cover;

a heating rod situated within the protective cover;

a tip of the heating rod, said tip transfers heat from the heating rod to the paraffin deposits thereby melting thereof; said tip is attached to the protective cover;

an induction coil mounted on a frame accommodating turns of the induction coil and thermally insulating thereof; said induction coil and said frame are situated within the protective cover; said induction coil is formed as a first part of a harness composed of a predetermined number of wires;

a passage bushing situated within and secured in the protective cover;

an induction coil extension formed as a second part of said harness; said induction coil extension is fixed within said passage bushing;

a connector assembly mechanically joining the heating rod with the passage bushing; said connector assembly is situated within the protective cover;

an inductor cap joined with an upper portion of the passage bushing;

a compensator communicating with the inductor cap through a hollow channel; said compensator is mounted above the inductor cap;

wherein an internal cavity is formed at least by the following elements:

an upper surface of the tip; outer surface portions of the frame; an outer surface of the induction coil; portions of inner sidewalls of the protective cover; portions of inner sidewalls of the passage bushing; and inner sidewalls of the inductor cap; wherein:

said internal cavity is filled with a liquid filler having suitable electric insulation properties, providing the inductor with a capacity to withstand pressure of the borehole liquid developed in the borehole column, and providing for enhanced heat exchange of the induction heater with environment; and wherein:

any surplus of the liquid filler, formed in the internal cavity during operation of the induction heater, due to volumetric temperature expansion, flows into the compensator via the hollow channel.

2. The induction heater according to claim 1, wherein:

said predetermined number of wires in the harness is 350; said wires are enameled copper wires, having a diameter of 0.4 mm; said passage bushing is formed of a brass tube longitudinally cut into two half-tubes with sidewalls of 2 mm thick; the compensator is made of oil-resistant rubber capable to withstand action of organic sorbents; said protective cover is made of a polymer material; and the liquid filler is silicon-organic liquid.

3. The induction heater according to claim 1, wherein:

the inductor further comprising;

an inductor contact group mounted on a top surface of the inductor cap; said inductor contact group consists of a number of sealed electrical contacts;

the control module further comprising:

a lower bushing located in a lower portion of said control module; the lower bushing mechanically joins said control module with said coupling; the lower bushing is attached to the inductor cap; and a control module contact group mounted at a bottom of the lower bushing; said control module contact group consists of a number of sealed electrical contacts;

and wherein:

said control module contact group is connected to said inductor contact group, thereby connecting said electronic components of the control module to the induction coil.

4. The induction heater according to claim 1, wherein:

said control module further comprising:

a housing formed as a hermetic hollow container; said housing accommodates and protects the electronic components from damaging factors;

a lower bushing located in a lower portion of the control module; the lower bushing mechanically joins said control module with said coupling; the lower bushing is attached to the inductor cap; and a control module container securing said electronic components therein; said control module container is disposed inside the housing.

5. The induction heater according to claim 4, wherein said inductor further comprising:

a temperature sensor located inside the tip; said temperature sensor measures temperature of the tip and converts the temperature into temperature signals; and a temperature signal channel located inside the heating rod and the tip;

said electronic components further including:

a CPU (Central Processing Unit) particularly connected with the temperature signal channel; wherein said temperature signal channel transmits the temperature signals from the temperature sensor essentially to the CPU; the CPU provides at least processed temperature signals; and a telemetry unit receiving at least the processed temperature signals from the CPU, encoding the processed temperature signals into telemetry signals, and transmitting the telemetry signals substantially to ground operating means for controlling power supplied to said induction heater.

6. The inductor heater according to claim 4, wherein said coupling further comprising:

an upper part attached to the lower bushing by means of threading connections;

a lower part attached to the inductor cap by means of threading connections;

a middle part situated between the upper part and the lower part; and a number of windows disposed within the middle part for passing said borehole liquid to an outer surface of the compensator.

7. The induction heater according to claim 1, wherein:

said induction heater is further associated with and controlled by ground operating means;

said electronic components further including:

a capacitor battery connected by electrical connections essentially to the induction coil, thereby creating a series LC-circuit, providing an HF magnetic field essentially heating up at least the heating rod and the tip;

an HF-transformer feeding power to the series LC-circuit;

a current transformer measuring electric current within the series LC-circuit, converting the electric current into current signals;

an HF-inverter generating voltage pulses transmitted to the HF-transformer;

a CPU;

a telemetry unit associated with the CPU;

said inductor further comprising:

a temperature sensor located inside the tip; said temperature sensor measures temperature of said tip and converts the temperature into temperature signals;

a temperature signal channel located inside the heating rod and the tip; said temperature signal channel transmits the temperature signals from the temperature sensor essentially to the CPU providing at least processed temperature signals; and wherein said telemetry unit receives at least the processed temperature signals from the CPU, encodes the processed temperature signals into telemetry signals, and transmits the telemetry signals substantially to the ground operating means for controlling power supplied to said induction heater.

8. The induction heater according to claim 7, wherein:

said electronic components further include a phase-locked loop (PLL) comprising:

a phase detector having at least: a current input receiving the current signals from the current transformer, wherein the current signals are proportional to current values of harmonic oscillations of electric current running in the series LC-circuit, and a voltage input receiving voltage signals being harmonic oscillations of LC-voltage measured on the series LC-circuit; said phase detector determines a phase shift between the current signals and the voltage signals; said phase detector converts the phase shift into a control voltage signal; and a voltage control oscillator (VCO) capable of generating a VCO pulse voltage with a VCO frequency based on the control voltage signal.

* * * * *